United States Patent [19]

Teraura et al.

[11] Patent Number: 4,501,218

[45] Date of Patent: Feb. 26, 1985

[54] STEERING SYSTEM FOR A BOAT

[75] Inventors: Makoto Teraura; Masanao Baba, both of Takarazuka, Japan

[73] Assignee: Nippon Cable System, Inc., Takarazuka, Japan

[21] Appl. No.: 567,290

[22] Filed: Dec. 30, 1983

[30] Foreign Application Priority Data

Jul. 20, 1983 [JP] Japan ..... 58-132481

[51] Int. Cl.[3] ..... B63H 25/02

[52] U.S. Cl. ..... 114/144 R; 440/60; 440/53; 74/498; 74/89.17

[58] Field of Search ..... 74/422, 89.17, 498, 74/480 B, 484, 501 R, 89.18, 130; 114/144 R, 156, 159; 440/53, 58, 60; 180/145; 403/13, 14; 226/196; 254/389, 95

[56] References Cited

U.S. PATENT DOCUMENTS 3,110,193 11/1963 Bratz ..... 74/480 B 3,208,300 9/1965 Morse ..... 114/144 R

*Primary Examiner*—Trygve M. Blix

*Assistant Examiner*—Edwin L. Swinehart

*Attorney, Agent, or Firm*—Armstrong, Nikaido, Marmelstein & Kubovcik

[57] ABSTRACT

A steering system for a boat, comprising a steering unit, at least one push-pull control cable and a pinion-rack unit.

The above pinion-rack unit has a rack casing, a rack slidably inserted into the rack casing, a cable guide for outwardly guiding an inner cable of the push-pull control cable; the inner cable being inserted into an inner cable path formed in a surface of the rack, a small guide groove being formed in the inner cable path and a small projection piece slidably inserted into the small guide groove and is formed on the front bottom portion of the cable guide, whereby the inner cable can be very smoothly operated and the space for arranging the push-pull control cable can be saved.

9 Claims, 8 Drawing Figures

STEERING SYSTEM FOR A BOAT

BACKGROUND OF THE INVENTION

The present invention relates to a novel steering system for a boat, and more particularly to a steering system for remotely controlling a rudder means through a push-pull control cable by means of a rotational operation of a steering wheel provided at a operator's seat of a boat.

Hitherto, a mechanism disclosed in the U.S. Pat. No. 3,208,300, as an example, has been known as a steering system mentioned above. As shown in FIG. 7, the conventional steering mechanism has a pinion 52 fixed to a steering shaft 51, a rack 53 being meshed with the pinion 52, an inner cable 54 of a push-pull control cable having an end portion connected with the rack 53, a rack cartridge 55 containing and guiding slidably the rack 53, and the like. Thereby, a rotational operation of a steering wheel is changed into a sliding linear motion of the inner cable 54, and a rudder means is operated.

In such a kind of steering system, since the inner cable 54 acts in the pushing direction, it is necessary to guide the inner cable 54 extending from an outer casing 57 in order to protect the inner cable 54 from buckling during the whole reciprocating stroke of the inner cable 54. Therefore, in the conventional steering system shown in FIG. 7, a rod 58 which is longer than the reciprocating stroke is connected to the end of the inner cable 54. Further, a guide pipe 59 is provided in the rack cartridge 55 or a rack casing in order to guide the inner cable 54 which comes out of the outer casing 57. That is to say, many members, e.g. the rod 58, the guide pipe 59, and the like, are employed in the conventional steering system. Further, there is a disadvantage that the construction is very complex and frictional resistance is high, since the rod 58, the guide pipe 59, the rack 53 and the rack cartridge 55 are telescopically inserted with each other. Also, the conventional system has another disadvantage that the width of the system is very wide, since a member 60 for fixing the outer casing 57 of the control cable is fastend to one end of the rack cartridge 55. Therefore, a wide space is required in the conventional system. Also, when the push-pull control cable is arranged in a narrow space of a boat, the sliding frictional resistance in the control cable becomes large, since a radius of curvature of a curved portion of the push-pull control cable becomes small.

OBJECT OF THE INVENTION

A main object of the present invention is to provide a steering system for a boat which does not require a wide space for setting, especially in width.

Another object of the present invention is to provide a steering system in which a push-pull control cable extending from a driving unit of the system can be arranged in a large radius of curvature.

Another object of the invention is to provide a steering system in which an inner cable is smoothly guided outwardly from a center portion or the neighborhood thereof of the rack casing.

Another objects and advantages of the invention will become apparent from the following description with reference to the accompanying drawings.

DETAILED EXPLANATION OF THE INVENTION

Figure 1:
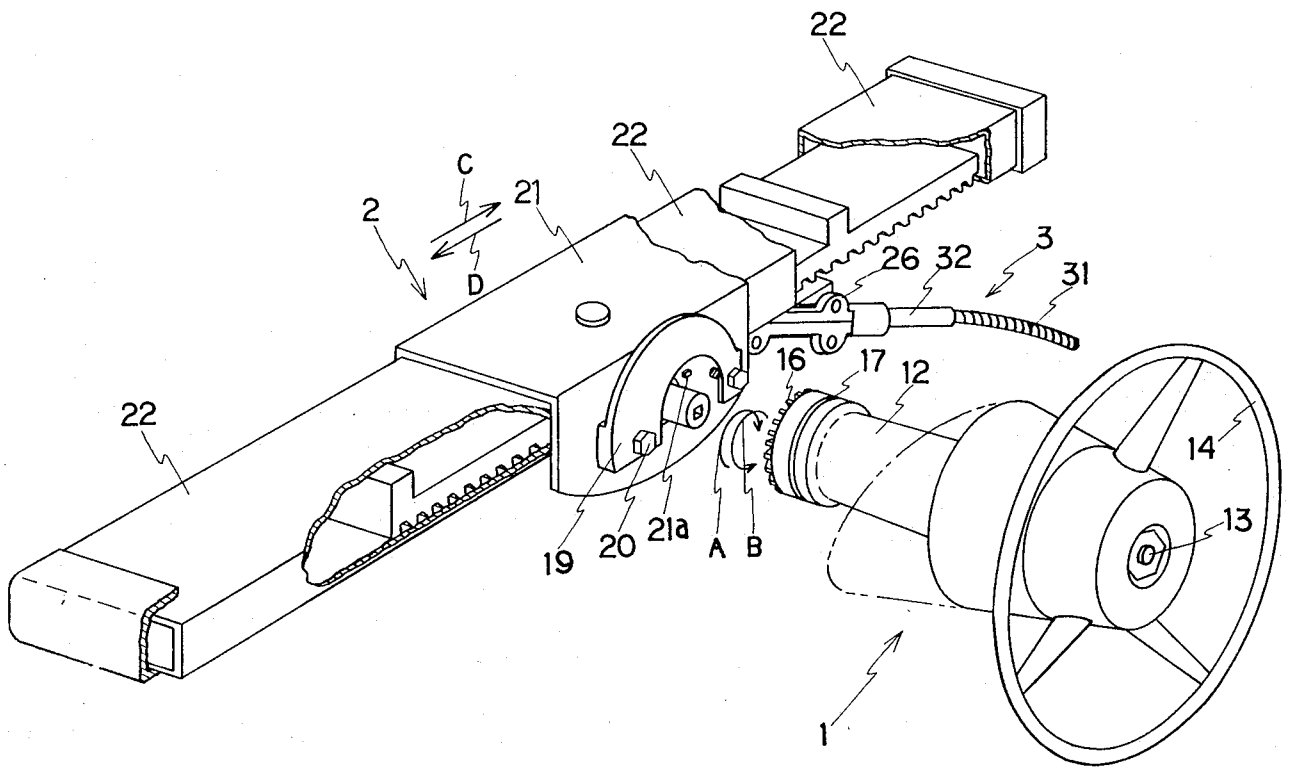
FIG. 1 is a partially cutaway perspective view showing an embodiment of a steering system of the present invention.

A steering system of the present invention has three structural parts, i.e. a steering unit 1, a pinion-rack unit 2 and at least one push-pull control cable 3, as shown in FIG. 1.

Figure 2:
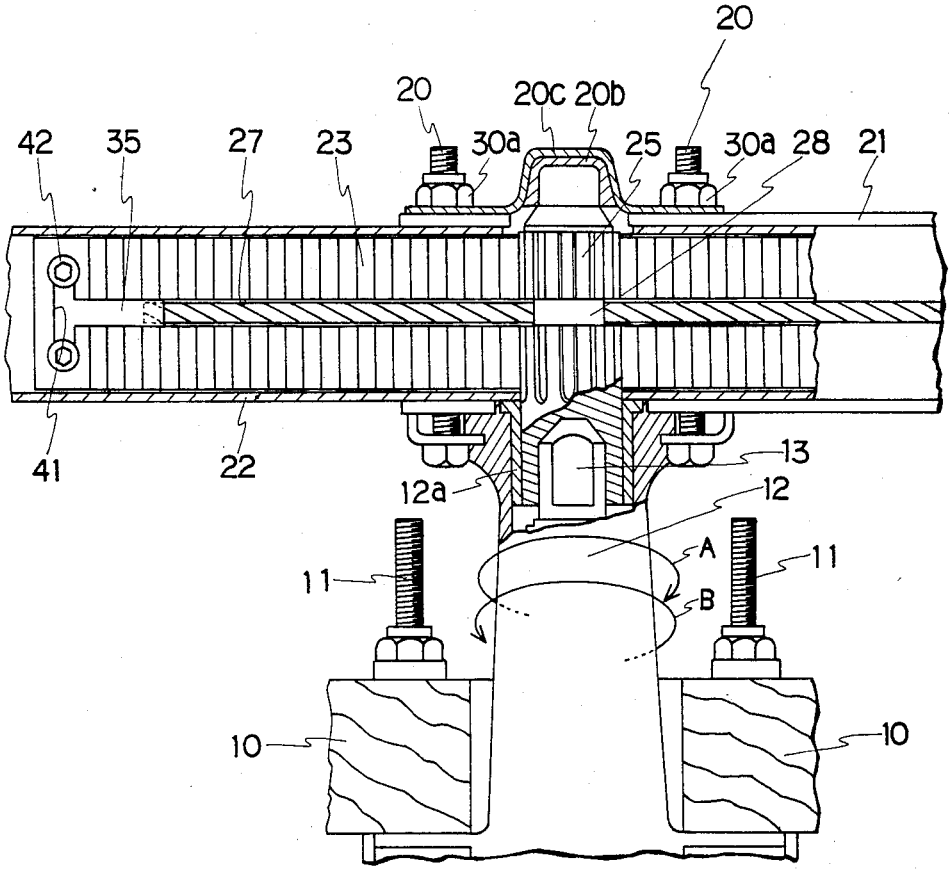
FIG. 2 is a partially cutaway bottom view showing the embodiment of the steering system of the invention shown in FIG. 1.

As shown in FIG. 2 in detail, the steering unit 1 comprises a housing 12 mounted on a dashboard 10 of an operator's seat of a boat by means of bolts 11, or the like, a steering shaft 13 rotatably inserted into the housing 12 and a steering wheel 14 fixed to an end portion of the steering shaft 13.

Figure 3A:
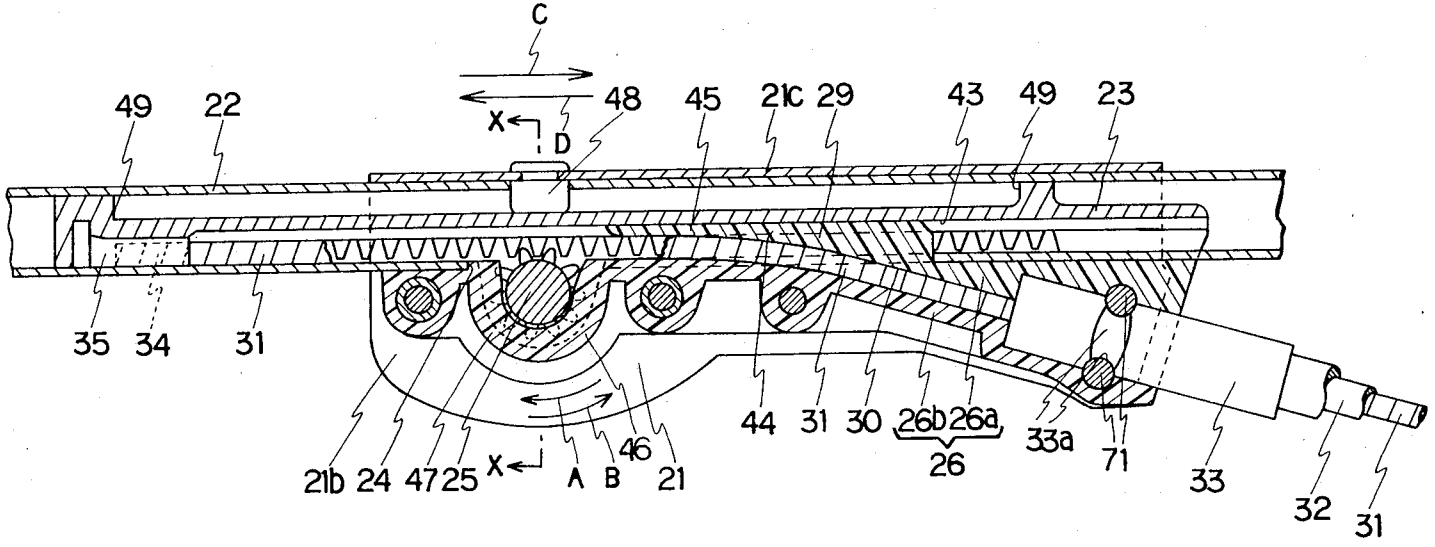
FIG. 3*a* is a longitudinal sectional view of a pinion-rack unit in the embodiment of the steering system of the invention shown in FIG. 1.
Figure 3B:
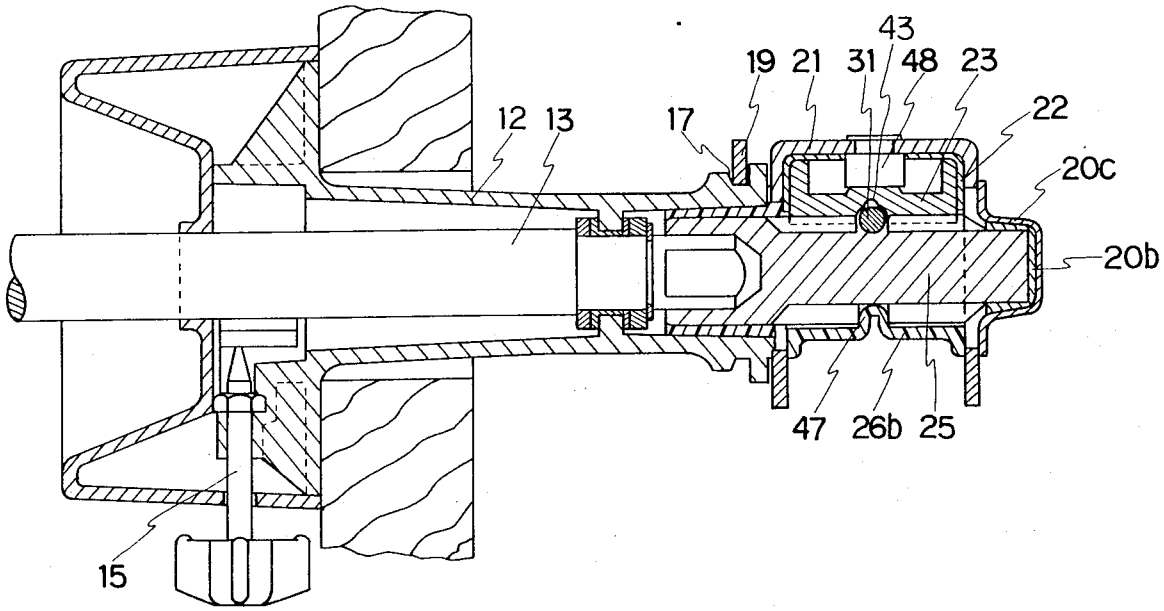
FIG. 3*b* is a sectional view on line X—X of FIG. 3*a;*

As shown in FIG. 3*b*, a braking means 15 for adjusting a rotational resistance of the steering shaft 13 is provided on the housing 12. A set of circularly-arranged teeth 16 is formed at a top end portion of the housing 12. The set of teeth 16 engages with several projections 21*a* formed on a bracket 21. Further, an annular groove 17 is formed around the outer surface in the neighborhood of the top end portion of the housing 12.

The pinion-rack unit 2 possesses, as shown in FIGS. 3*a* and 3*b*, a bracket 21. The bracket 21 is formed by bending up both side portions of a metal plate. That is to say, the bracket 21 has a bottom plate 21*c* and two side walls 21*b* and has C-shaped form in section. A rack casing 22 having a rectangle-pipe-form is inserted to the inside of the bracket 21. A rack 23 is slidably inserted into the rack casing 22. Further, the pinion-rack unit 2 possesses a pinion 25 being meshed with the rack 23 and a cable guide 26 for guiding an inner cable 31 of a push-pull control cable 3. The rack 23 is arranged so that a teeth surface side 23*a* turns down. An opening 24 is formed at a center portion or its neighborhood of the rack casing 22. The teeth surface side 23*a* faces the opening 24. The pinion 25 being meshed with the rack 23 is provided in the neighborhood of the opening 24. After the bracket 21 and the housing 12 are combined by a means for combining, e.g. a U-shaped lock plate 19, bolts 20, and the like, as mentioned later, the pinion 25 is rotatably supported with an end portion of the housing 12 and a bushing 12*a* in the housing 12, and the pinion 25 is securely connected with the steering shaft 13.

Figure 4:
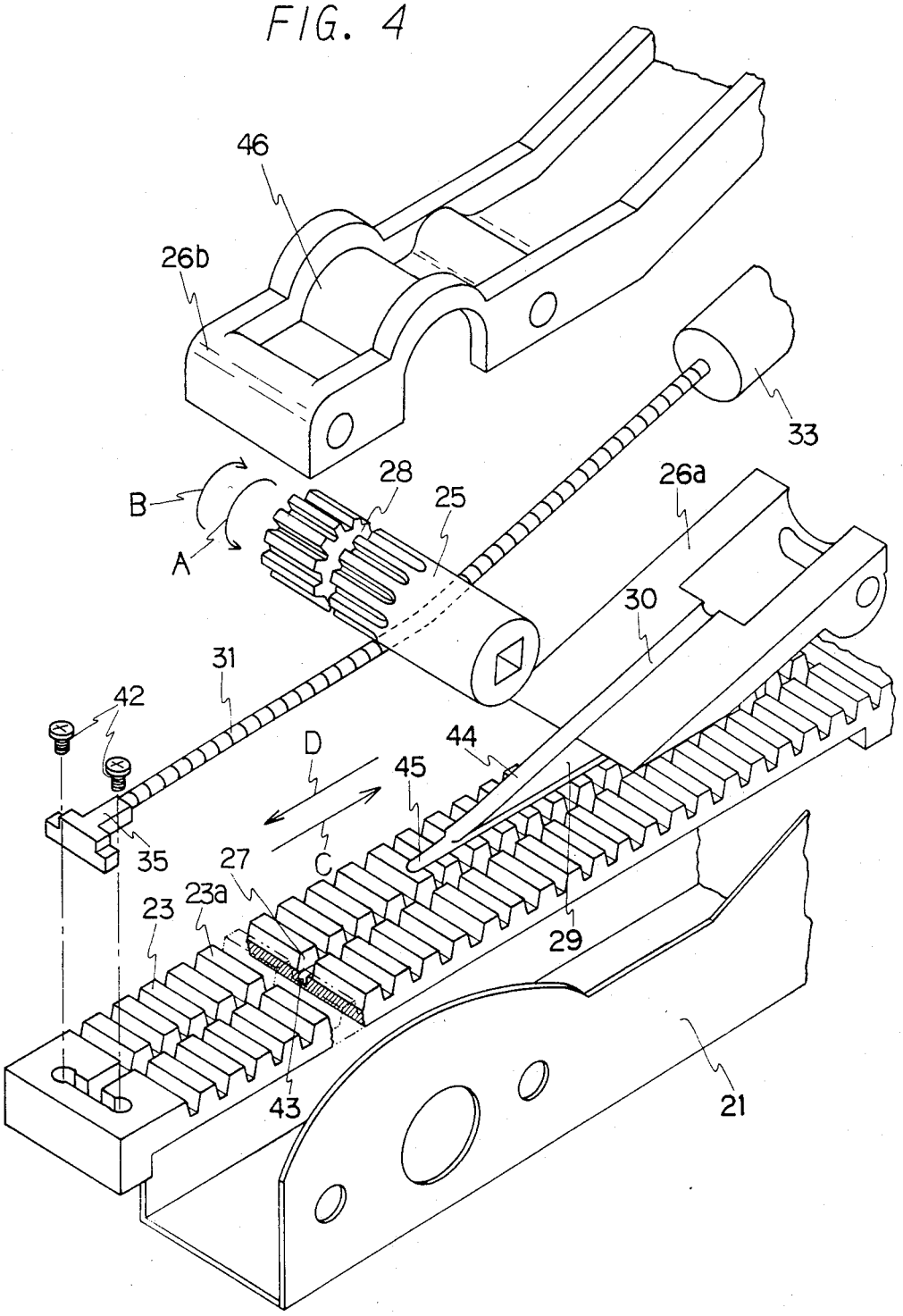
FIG. 4 is a segmentary exploded view in perspective of the embodiment (a rack casing is omitted) of the steering system of the invention shown in FIGS. 1 to 3.

In FIG. 4, the teeth surface side 23*a* of the rack 23 turns upward in order to show a meshing relation of the pinion 25 and the rack 23. An open groove 27 extending in the longitudinal direction of the rack 23 is formed as an inner cable path for inserting the inner cable 31 at the teeth surface side 23*a* of the rack 23. An annular open groove 28 is provided around the pinion 25 and at a position facing the open groove 27. Therefore, though the pinion 25 and the rack 23 are meshed together, an inner cable 31 can be inserted through a gap between teeth of the pinion 25 and teeth of the rack 23.

A cable guide 26 is mounted on the rack casing 22. A front side of the cable guide 26 is inserted in the opening 24. A rear side of the cable guide 26 extends outwardly with a slight gradiant in relation to the longitudinal direction of the rack casing 22. In the embodiment of the steering system shown in FIGS. 1 to 3, the cable guide 26 is arranged between the side walls 21*b* of the bracket 21 and is fixed by means of pins, or the like. A projection piece 29 contacing slidably with a bottom surface of the open groove 27 is provided at a bottom portion of the front side of the cable guide 26. A guide groove 30 or a guide hole for guiding the inner cable 31 is formed through the cable guide 26 from a surface of the projection piece 29 to the rear end. As shown in FIG. 4 in detail, in this embodiment, the cable guide 26 is divided into two pieces, i.e. a body 26*a* and a cover 26*b*, along the guide groove 30, whereby the inner cable 31 can be easily inserted into the guide groove 30.

The push-pull control cable 3 comprises a flexible inner cable 31 for transmitting a tensile force and a compressive force and the flexible outer casing 32 for guiding slidably the inner cable 31. An end portion of the outer casing 32 is engaged with an end portion of the rear side of the cable guide 26 by means of a fitting member 33, and the other end of the outer casing 32 is engaged to a rudder means, e.g. a rudder 61 in FIG. 6. As shown in FIGS. 2 and 4, a T-shaped end fitting 35 is securely caulked at an end 34 of the inner cable 31. The end fitting 35 is inserted into a lateral groove 41 formed perpendicularly to the open groove 27 and arranged at the front end of the open groove 27. The end fitting 35 is fixed to a front portion of the rack 23 by means of screws 42, or the like. The opposite end of the inner cable 31 is engaged to an operable member 62, e.g. a connecting rod of the rudder means 61 mentioned above. The inner cable 31 contained in the open groove 27 is inserted into the gap between the pinion 25 and the rack 23. The course of the inner cable 31 is smoothly changed by the cable guide 26 having the front portion inserted into the opening 24, and the inner cable 31 is guided to the outer casing 32.

As shown in FIGS. 3*b* and 4, in the steering system of the invention, a small guide groove 43 is formed at the bottom of the open groove 27 of the rack 23. A small projection piece 45 is provided at the front portion of the projection piece 29 so that the small projection piece 45 can be slidably moved in the small guide groove 43. The projection piece 29 has a slant guide surface 44 for spooning the inner cable 31. An upper surface of the small projection piece 45 is in the similar position with the bottom surface of the open groove 27.

Hereinafter, an operation of the steering system of the invention constructed as mentioned above is described.

As referring in FIG. 1 and FIG. 3*a*, when the steering wheel 14 is operated to rotate in the direction of an arrow A or B, the pinion 25 is rotated in the same direction. Accompanying the rotational motion of the pinion 25, the rack 23 takes a linear motion in the direction of an arrow C or D. Therefore, the inner cable 31 having an end 34 engaged with an end of the rack 23 is pushed or pulled by the rack 23 and takes a linear motion. The inner cable 31 is slidably guided and smoothly turned in the slant direction along the cable guide 26. Further, the inner cable 31 goes out of the center portion or its neighborhood of the rack casing 22. The inner cable 31 advances through the outer casing 32 and drives the rudder means 61 to swivel.

Figure 6:
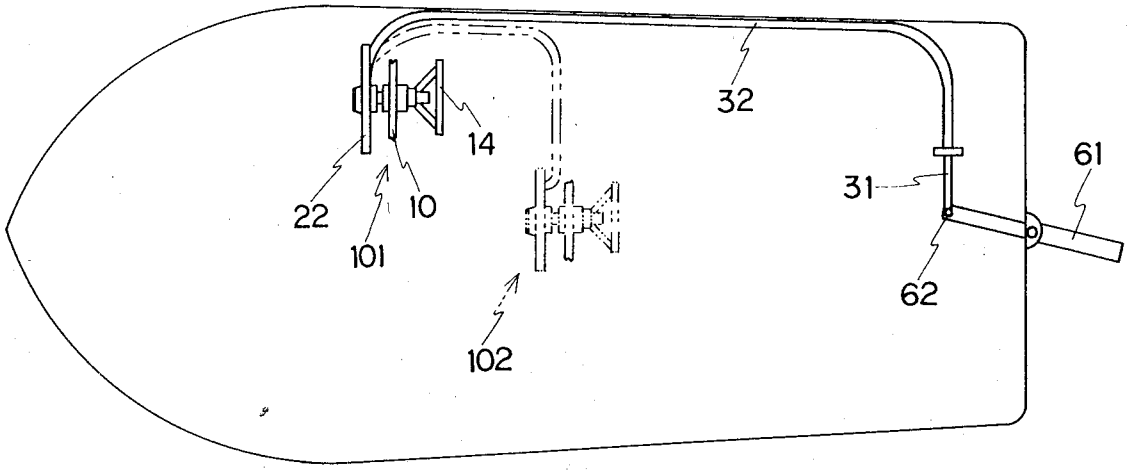
FIG. 6 is a schematic plan view of an example of a boat employing a steering system of the invention.
Figure 7:
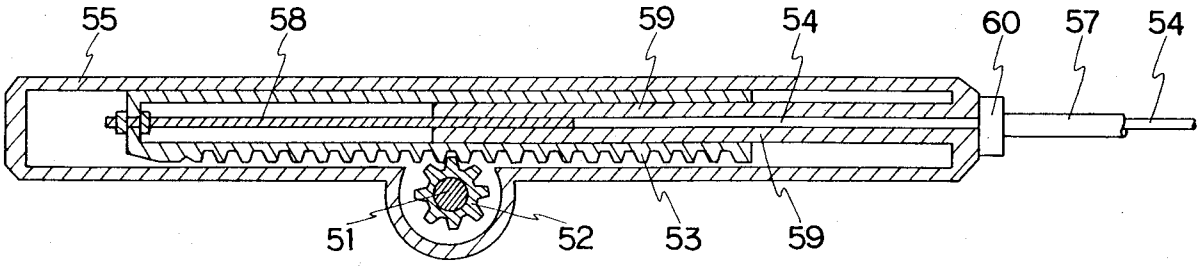
FIG. 7 (PRIOR ART)
FIG. 7 is a longitudinal sectional view showing an example of a conventional steering system for a boat.

On the other hand, when a first steering system 101 having a rack connected with two inner cables and a similar second steering system 102 shown by the two-dot-chain lines in FIG. 6 are respectively mounted on a boat, and one of the inner cables coming out of the first steering system 101 is engaged to a rack of the second steering system 102, an operator can remotely control a rudder means through desired one of the two steering systems 101, 102.

In a general sense, a rack 23 is arranged so that the teeth surface side 23*a* is turns downward in order to accord a rotational direction of a steering wheel with a turning direction of the boat. In the steering system of the invention shown in FIG. 1, since the inner cable 31 is arranged at the teeth surface side 23*a* of the rack 23, the push-pull control cable 3 can be directed downward in the above general arrangement of the pinion-rack unit 2. Accordingly, the push-pull control cable 3 can be easily arranged through the bottom of the boat.

Further, in the steering system of the invention, since the push-pull control cable 3 extends in a downward inclined direction from the center portion or its neighborhood of the pinion-rack unit 2, the push-pull control cable can be arranged in a large radius of curvature, and a space for arranging the control cable 3 can be saved.

Further, in a steering system of the invention, the small projection piece 45 is projected from the front portion of the cable guide 26 and is slidably inserted into the small guide groove 43 formed in the bottom surface of the open groove 27 of the rack 23. Therefore, when the steering wheel 14 is rotated in the direction of the arrow A and accordingly the rack 23 is slided in the direction of the arrow C, the inner cable 31 moving in the direction of the arrow C with the rack 23 can be smoothly spooned up by the projection piece 29 without slack and guided by the cable guide 26. Also, when the cable guide 26 is made of synthetic resin in order to decrease a friction with the inner cable 31, there is an advantage that wearing of the top portion of the projection piece 29 can be remarkably reduced.

In the steering system of the invention, as shown in FIGS. 3*a* to 4, when the cable guide 26 is provided with a pinion-cover 46 having a semi-circular ring-shaped projection 47 capable of inserting in the annular groove 28, the pinion 25 can be safely held by the pinion cover 46 until the pinion-rack unit 2 and the steering unit 1 are combined.

Also, in the steering system of the invention, when a projection 48 is provided at the bottom plate 21*c* of the bracket 21, and the rear side of the rack 23 is pushed by the top of the projection 48, a backlash between the rack 23 and the pinion 25 can be kept in a suitable amount. Further, when the projection 48 is constructed so that the project height is adjustable by means of an adjusting means, e.g. a screw means, the backlash can be suitably and easily adjusted in accordance with each steering system.

When stoppers 49 which can engage with the projection 48 are provided in the neighborhood portions of both ends of the rear side of the rack 23, a slide stroke of the rack 23 can be easily and surely limitted.

A steering system of the invention has a steering unit 1 mounted on the front side of the dashboard 10, a pinion-rack unit 2 arranged behind the dashboard 10 and a control cable 3. Therefore, the steering unit 1 and the pinion-rack unit 2 are divided, and a means for easily combining the housing 12 and the bracket 21 is employed. In the embodiment of the steering system of the invention shown in FIG. 1, an annular groove 17, a U-shaped lock plate 19 and at least two bolts 20 are employed as the means for combining. The annular groove 17 is formed around the neighborhood portion of the top end of the housing 12. The lock plate 19 has an inner surface 18 capable of being inserted into the annular groove 17. The bolts 20 are inserted into bolt holes perforated through both end portions of the lock plate 19 and are connected to the side surface of the bracket 21. The bolts 20 have long screw portions. That is to say, when the means for combining is constructed as mentioned above, the pinion-rack unit 2 can be supported with the housing 12 by merely hanging the inner surface 18 of the lock plate 19 to the annular groove 17 around the top end portion of the housing 12. In the above situation, the pinion-rack unit 2 can be swivelled around the housing 12. Accordingly, by swivelling the pinion-rack unit 2 to a suitable angle, for example to the horizontal or to an inclined state in a certain angle out of the horizontal, engaging the set of circular teeth 16 to the projections **21*a* of the bracket 21, attaching the pinion-bearing 20*b* and the cover 20*c* to the bolts 20, and tightening nuts 30*a* around the bolts 20, the pinion-rack unit 2 can be easily combined to the housing 12 without supporting a weight of the pinion-rack unit 2** by hands, or the like.

In FIG. **3*a*, there is shown a preferable embodiment of a connection of a fitting member 33 fixed to an end of an outer casing 32 and a cable guide 26. In the embodiment of a connection, the outer surface of the metal fitting member 33 has four cut portions or concaves 33*a* having cylindrical surfaces. Those cut portions 33*a* are perpendicularly arranged to each other, whereby two set-pins 71 inserted through the cable guide 26 are engaged with the cut portions 33*a*. Therefore, when the push-pull control cable 3 is connected to the pinion-rack unit 2, the fitting member 33 and the set-pins 71 can be engaged without twisting the push-pull control cable 3. Further, since contact areas between the set-pins 71 and the fitting member 33 are wide, the fitting member 33 can be securly engaged with the cable guide 26**.

Though in the above-described embodiment, an inner cable path for inserting an inner cable is an open groove 27 which is formed along the center line of the teeth surface side **23*a*, the present invention is not limitted in the above case. For example, as referring in FIG. 5, a cut portion 23*b* formed at a shoulder portion of a rack 23 can be employed as an inner cable path. Further, in case that two steering systems shown in FIG. 6 or two rudder means are synclonously operated, or in case that two control cables are necessary since an engine power is too high to control a rudder through only one control cable, two inner cables 31 can be driven by one rack 23. In those variations of the present invention, the rack 23 is provided with two inner cable paths, e.g. two cut portions 23*b*, two open grooves 27**, or the like.

Figure 5:
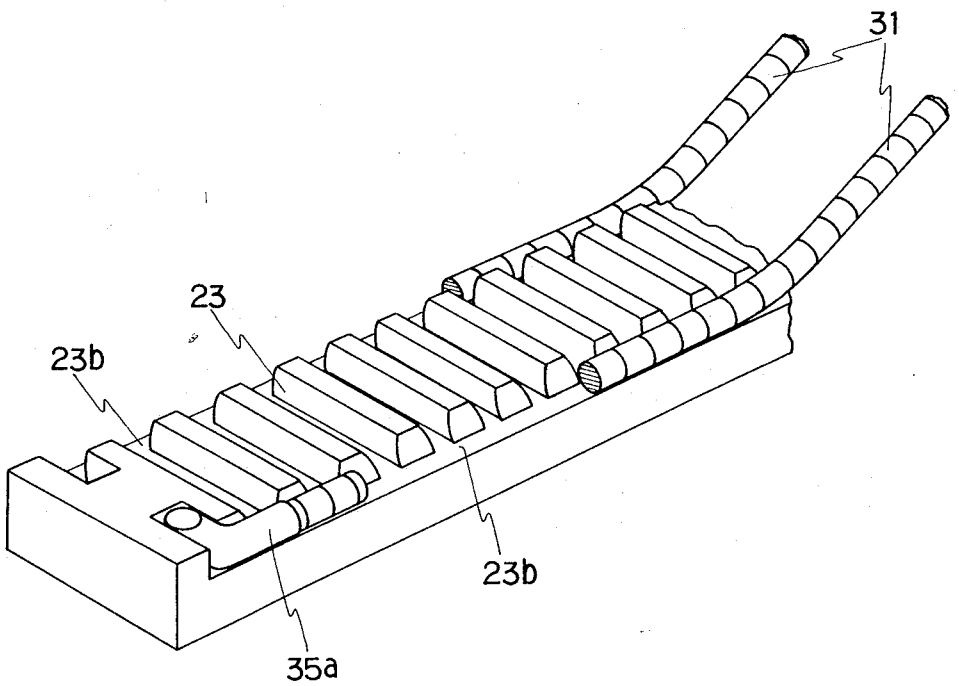
FIG. 5 is a segmentary perspective view showing another embodiment of a steering system of the invention.

When the inner cable 31 extending along the above cut portion **23*b* is engaged with rack 23, a L-shaped end fitting 35*a* shown in FIG. 5** can be preferably employed.

As described above, a steering system for a boat of the present invention has many advantages that a setting space for a pinion-rack unit and a push-pull control cable is reduced; the push-pull control cable can be easily arranged in a bottom of a boat; and an inner cable can be smoothly guided from a rack to a cable guide.

Though, in the above explanations and drawings, some preferred embodiments of a steering system of the present invention are described, various changes and modifications may be made in the invention without departing from the spirit and the scope thereof.

What is claimed is:

1. A steering system for a boat, comprising:

(a) a rack casing having an opening formed at a center portion or the neighborhood portion thereof; said rack casing being pipe-shaped;

(b) a rack slidably inserted into said rack casing; said rack having a teeth surface side facing said opening; said rack being provided with at least one inner cable path for inserting an inner cable; said inner cable path extending in the longitudinal direction of said rack;

(c) a pinion arranged at said opening; said pinion being meshed with said rack;

(d) at least one inner cable of a push-pull control cable; one end of said inner cable being engaged to an end portion of said rack; the other end of said inner cable being connected to a rudder means or another steering system;

(e) a cable guide having a front end portion inserted into said inner cable path and having at least one guide groove extending from said front end portion to a rear end portion for slidably guiding said inner cable;

(f) an outer casing of said push-pull control cable; one end of said outer casing being connected to said rear end portion of said cable guide; said outer casing slidably guiding said inner cable to said rudder means or said another steering system;

(g) a bracket connecting said cable guide to said rack casing;

(h) a steering shaft having an end portion securely connected with said pinion;

(i) a housing rotatably supporting said steering shaft;

(j) a means for combining said cable guide and said rack casing connected together to said housing;

(k) a small guide groove formed in a bottom surface of said inner cable path; said small guide groove extending along said inner cable path; and (l) a small projection piece provided at a bottom portion of said front end portion of said cable guide; said small projection being slidably inserted into said small guide groove.

2. A steering system for a boat of claim 1, wherein said inner cable path is an open groove formed in said teeth surface side of said rack, an annular groove is formed around said pinion, and said annular groove faces said open groove.

3. A steering system for a boat of claim 1, wherein said inner cable path is at least one cut portion formed in at least one shoulder portion of said teeth surface side of said rack.

4. A steering system for a boat of claim 2, wherein said cable guide is provided with a part covering said pinion and a semi-circular ring-shaped projection formed on an inside surface of said part, and said semicircular ring-shaped projection is slidably inserted into said annular groove of said pinion.

5. A steering system for a boat of claim 1, wherein said bracket has a bottom plate and side walls perpendicularly extending from both sides of said bottom plate, said bottom plate contacts with an outer surface of a rear side of said rack casing, said side walls contacts with outer side surfaces of said rack casing, said cable guide is provided between said side walls, a hole is perforated in said rear side of said rack casing, a projection extends from said bottom plate of said bracket, said projection is inserted into said hole, and said projection has a top surface slidably contacting with a rear side surface of said rack.

6. A steering system for a boat of claim 5, wherein said rack is provided with stoppers at said rear side surface thereof, whereby said stoppers restrict a reciprocal sliding linear motion of said rack by engaging with said projection.

7. A steering system for a boat of claim 1, wherein said means for combining comprises:

an annular groove formed around the neighborhood portion of a top end of said housing;

a U-shaped lock plate having an inner surface being rotatably inserted into said annular groove; said lock plate having at least two bolt holes; and at least two bolts being connected to said bracket through said bolt holes.

8. A steering system for a boat of claim 2, wherein a lateral groove is formed in a top end portion of said open groove, a T-shaped end fitting is securely fixed at said end portion of said inner cable, and said end fitting is engaged with said lateral groove and said open groove.

9. A steering system for a boat of claim 3, wherein a lateral groove is formed in a top end portion of said cut portion, an L-shaped end fitting is securely fixed at said end portion of said inner cable, and said end fitting is engaged with said lateral groove and said cut portion.

* * * * *